US005339838A

United States Patent [19]

Young et al.

[11] Patent Number: 5,339,838

[45] Date of Patent: Aug. 23, 1994

[54] METHOD FOR PROVIDING A RECONSTITUTED TOBACCO MATERIAL

[75] Inventors: Harvey J. Young, Advance; Edward Bernasek, Winston-Salem; Aju N. Lekwauwa, Winston-Salem; Walter R. D. Young, Jr., Winston-Salem, all of N.C.

[73] Assignee: R. J. Reynolds Tobacco Company, Winston-Salem, N.C.

[21] Appl. No.: 931,248

[22] Filed: Aug. 17, 1992

[51] Int. Cl.[5] ..... A24B 15/12

[52] U.S. Cl. ..... 131/372

[58] Field of Search ..... 131/297, 372

[56] References Cited

U.S. PATENT DOCUMENTS

| | | | |
|---|---|---|---|
| 2,708,175 | 5/1955 | Samfield et al. | 131/355 |
| 2,845,933 | 8/1958 | Samfield et al. | 131/370 |
| 3,353,541 | 11/1967 | Hind et al. | 131/353 |
| 3,385,303 | 5/1968 | Hind et al. | 131/353 |
| 3,386,449 | 6/1968 | Hind | 131/370 |
| 3,386,450 | 6/1968 | Seligman et al. | 131/354 |
| 3,398,754 | 9/1968 | Tughan | 131/374 |
| 3,409,026 | 11/1968 | Hind et al. | 131/370 |
| 3,411,514 | 11/1968 | Hind et al. | 131/290 |
| 3,411,515 | 11/1968 | Hind et al. | 131/370 |
| 3,420,241 | 1/1969 | Hind et al. | 131/370 |
| 3,428,053 | 2/1969 | Schoenbaum et al. | 131/373 |
| 3,435,829 | 4/1969 | Hind et al. | 131/370 |
| 3,464,422 | 9/1969 | Light | 131/353 |
| 3,480,018 | 11/1969 | Fairchild | 131/355 |
| 3,483,874 | 12/1969 | Hind | 131/309 |
| 3,540,455 | 11/1970 | Fiore | 131/353 |
| 3,540,456 | 11/1970 | McGlumphy et al. | 131/337 |
| 3,616,801 | 11/1971 | Hind | 131/297 |
| 3,760,815 | 9/1973 | Deszyck | 131/309 |
| 3,847,164 | 11/1974 | Mattina et al. | 131/297 |
| 4,182,349 | 1/1980 | Selke | 131/374 |
| 4,270,552 | 6/1981 | Jenkins et al. | 131/290 |
| 4,333,484 | 6/1982 | Keritsis | 131/372 |
| 4,337,783 | 7/1992 | Hooper et al. | 131/375 |
| 4,341,228 | 7/1982 | Keritsis et al. | 131/354 |
| 4,421,126 | 12/1983 | Gellatly | 131/371 |
| 4,611,608 | 9/1986 | Vos et al. | 131/354 |
| 4,674,519 | 6/1987 | Keritsis et al. | 131/355 |
| 4,706,692 | 11/1987 | Gellatly | 131/370 |
| 4,861,427 | 8/1989 | Johnson et al. | 162/129 |
| 4,874,000 | 10/1989 | Tamol et al. | 131/375 |
| 4,880,018 | 11/1989 | Graves, Jr. et al. | 131/375 |
| 4,962,774 | 10/1990 | Thomasson et al. | 131/309 |
| 4,972,854 | 11/1990 | Kiernan et al. | 131/353 |
| 4,987,906 | 1/1991 | Young et al. | 131/297 |
| 5,025,814 | 6/1991 | Raker | 131/331 |
| 5,099,864 | 3/1992 | Young et al. | 131/372 |
| 5,101,839 | 4/1992 | Jakob et al. | 131/352 |

OTHER PUBLICATIONS

*Tobacco Encyclopedia,* Edited by Voges, pp. 389–390, TJI (1984).

Silberstein, TJI, vol. 1, pp. 26–29 (1985).

*Primary Examiner*—George J. Marlo

[57] ABSTRACT

The present invention relates to a method for providing a reconstituted tobacco material. The process includes contacting tobacco material with a liquid having an aqueous character to provide a mixture (slurry). The slurry is then contacted with a pectin release agent. The tobacco material having released tobacco pectins is then formed into a predetermined shape. The formed slurry having released tobacco pectins is subjected to conditions sufficient to crosslink the released tobacco pectins (e.g., contacting with a crosslinking agent). The formed slurry having crosslinked tobacco pectins is dried to provide a reconstituted tobacco material.

24 Claims, 2 Drawing Sheets

METHOD FOR PROVIDING A RECONSTITUTED TOBACCO MATERIAL

BACKGROUND OF THE INVENTION

The present invention relates to a method of preparing a substrate useful for smoking articles, and particularly to a reconstituted tobacco material for the same.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate circumscribed by plug wrap, and is attached to the tobacco rod using a circumscribing tipping material. See, Baker, *Prog. Ener. Combust. Sci.,* Vol. 7, pp. 135–153 (1981).

Typical cigarettes include blends of various tobaccos, such as the flue-cured, Burley, Md. and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia,* edit. by Voges, pp. 389–390, TJI (1984). See, also, U.S. Pat. No. 3,385,303 to Hind, et al., U.S. Pat. No. 4,421,126 to Gellatly and U.S. Pat. No. 4,706,692 to Gellatly.

It would be desirable to provide a reconstituted tobacco material having mechanical and physical properties comparable to natural tobacco materials, and particularly to provide a reconstituted tobacco material having a low sheen, flat surface and being non-tacky.

SUMMARY OF THE INVENTION

The present invention relates to a method for providing a reconstituted tobacco material. The process includes contacting tobacco material with a liquid having an aqueous character to provide a mixture or slurry. The slurry is then contacted with a pectin release agent and subjected to conditions to provide a tobacco material having released tobacco pectins. The slurry of tobacco material having released tobacco pectins is then formed into a predetermined shape. The formed slurry having released tobacco pectins is subjected to conditions sufficient to crosslink the released tobacco pectins. For example, the formed slurry can be contacted with a crosslinking agent to crosslink the released tobacco pectins. The crosslinking agent can optionally be added to the slurry prior to being formed into a predetermined shape (e.g., immediately prior to the formation step). Exemplary crosslinking agents include a source of alkaline earth metal ions (e.g., calcium ions). An exemplary source of alkaline earth metal ions can be a water soluble tobacco extract. The formed slurry having crosslinked tobacco pectins is then dried to provide a reconstituted tobacco material. In one embodiment, the steps of contacting the formed slurry with a crosslinking agent and drying the formed slurry can be performed simultaneously.

In another embodiment, tobacco material is contacted with an extraction solvent to provide at least a portion of tobacco extract separate from extracted tobacco material. A slurry of the extracted tobacco material, optionally including additional tobacco material or extraction solvent or both, is subjected to conditions sufficient to release tobacco pectins (i.e., contacting with a pectin release agent). The slurry of extracted tobacco material having released tobacco pectins is formed into a predetermined shape. The formed extracted tobacco material having released tobacco pectins is subjected to conditions sufficient to crosslink the released tobacco pectins, namely contacting with a crosslinking agent to crosslink the released tobacco pectins to provide a reconstituted tobacco material having crosslinked tobacco pectins.

The resulting reconstituted tobacco material can be employed using techniques known in the art. For example, the reconstituted tobacco material can be provided in a sheet-like form having a thickness approximating that of tobacco leaf laminae; and the material can be used as is or can be blended with other tobacco materials, cut to the desired size, and employed as smokable cut filler. The reconstituted tobacco material can be rolled onto a bobbin and later formed into smokable rods using known techniques. For example, the reconstituted tobacco material can be slit, gathered and cut into strands such as described in U.S. Pat. No. 5,025,814 to Raker, the disclosure of which is incorporated herein be reference. The reconstituted tobacco material can be used as a substrate in a smoking article such as described in copending parent application, U.S. Ser. No. 07/800,679 filed Nov. 27, 1991, the disclosure of which is incorporated herein by reference.

Reconstituted tobacco materials which are manufactured according to the method of the present invention have excellent smoking properties and improved flavor attributes relative to reconstituted tobacco materials made using conventional processes and have mechanical and physical properties comparable thereto.

DETAILED DESCRIPTION OF THE PREFERRED EMBODIMENTS

Figure 1:
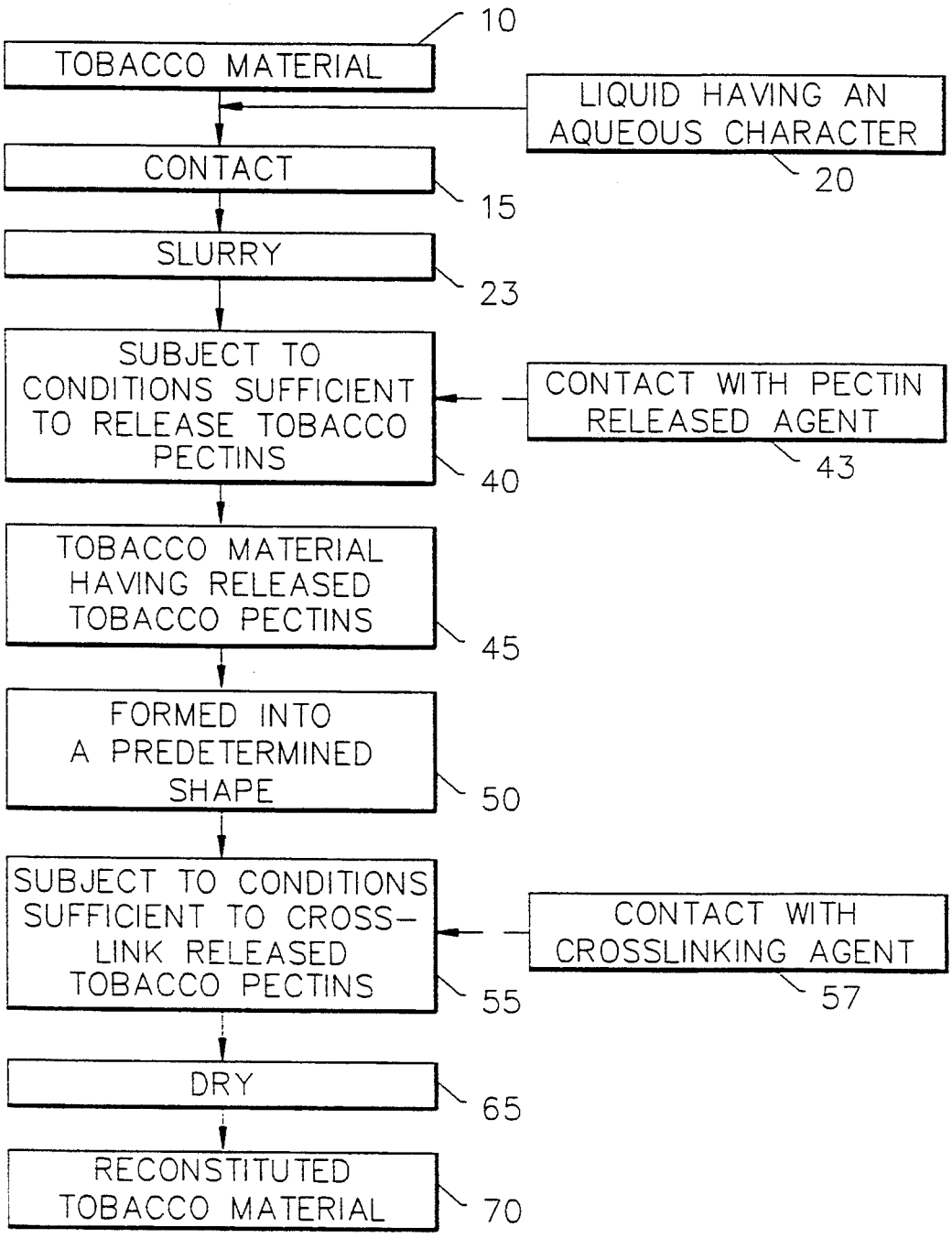
FIG. 1 is a schematic diagram of steps representative of an embodiment of the invention.

Referring to FIG. 1, tobacco material 10 is contacted 15 with a liquid having an aqueous character 20 to form a slurry 23. The slurry 23 is subjected 40 to conditions sufficient to release tobacco pectins to provide a tobacco material having released tobacco pectins 45. Preferably, the conditions include contacting 43 the tobacco material with a pectin release agent. The tobacco material having released tobacco pectins 45 is formed 50 into a predetermined shape and subjected 55 to conditions sufficient to crosslink the released tobacco pectins, namely contacting 57 the formed slurry with a crosslinking agent capable of crosslinking the released tobacco pectins. The tobacco material having crosslinked tobacco pectins is dried 65 to the desired moisture level to provide a reconstituted tobacco material 70. The steps of contacting 57 the formed slurry with a crosslinking agent and drying 65 formed slurry can optionally occur simultaneously.

Figure 2:
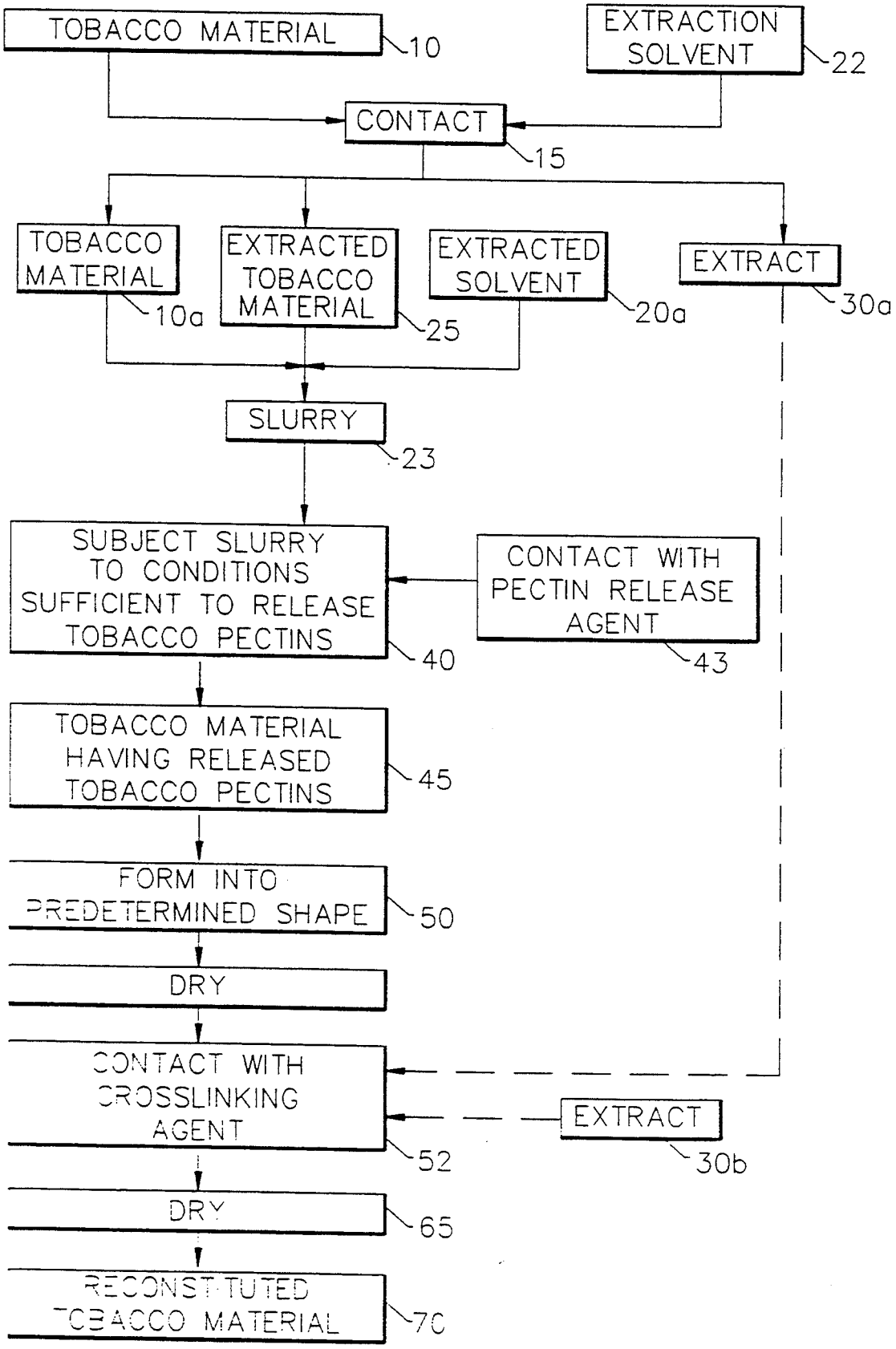
FIG. 2 is a schematic diagram of steps representative of another embodiment of the invention.

Referring to FIG. 2, another embodiment of the present invention is illustrated with like numerals indicating aspects common to those in FIG. 1. Tobacco material 10 is contacted 15 with an extraction solvent 22 to provide a portion of tobacco extract 30*a* separate from extracted tobacco material 25. A slurry 23 of the extracted tobacco material 25, and optionally including additional tobacco material 10*a* or a liquid having an aqueous character 20*a* is subjected 40 to conditions sufficient to release tobacco pectins to provide a tobacco material having released tobacco pectins 45. The tobacco material having released tobacco pectins 45 is formed 58 into a predetermined shape and contacted 52 with a crosslinking agent to crosslink the released tobacco pectins. The tobacco material having crosslinked tobacco pectins is dried 65 to provide a reconstituted tobacco material 70. The crosslinking agent is preferably a source of alkaline earth metal ions. An exemplary source is the tobacco extract 30*a* separated from the tobacco material 10 or can be a separate tobacco extract 30*b* obtained from a different portion of tobacco material.

Tobacco materials used in the process of the present invention can vary. Examples of suitable types of tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem, and can be ground to facilitate dispersing. All or part of the tobacco material can be previously cased and/or top dressed. The tobacco material can be screened or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan. Impurity removal, however, is not critical, and tobacco material having impurity levels of greater than 50 percent can be used. The aforementioned materials can be processed separately, or as blends thereof.

The tobacco material is dispersed in a liquid having an aqueous character or is contacted with a extraction solvent at a temperature of greater than ambient temperature (i.e., 25° C.), sometimes greater than about 35° C., and often greater than about 55° C. Such a liquid or solvent consists primarily of water, normally greater than 90 weight percent water, and can be essentially pure water in certain circumstances. Essentially pure water includes deionized water, distilled water and tap water. However, the liquid can include substances such as pH buffers or the like dissolved therein. The liquid also can be a co-liquid mixture of water and minor amounts of one or more solvents which are miscible therewith. An example of such a co-liquid mixture is a liquid consisting of 95 parts water and 5 parts ethanol. To facilitate dispersing in a liquid having an aqueous character or extracting with a solvent, the tobacco material is preferably ground to pass at least a 20 mesh (Tyler) screen and preferably at least a 40 mesh (Tyler) screen.

The amount of tobacco material which is dispersed in the liquid or contacted with the solvent can vary. Typically, the weight of liquid relative to the tobacco material is greater than about 4:1, and often times greater than about 5:1. The amount of liquid or solvent relative to tobacco material depends upon factors such as the type of liquid or solvent, the type or form of tobacco which is used, and other such factors.

The tobacco material dispersed in the liquid having an aqueous character can be combined under conditions to provide a mixture (i.e., a slurry). Preferably these conditions include high shear mixing conditions such as described in commonly assigned U.S. Ser. No. 07/931,249, filed Aug. 17, 1992, the disclosure of which is incorporated herein by reference.

Alternatively, the tobacco material can be contacted with the extraction solvent under conditions to provide a portion of tobacco extract separate from extracted tobacco material. A slurry of the extracted tobacco material is formed, and can include additional unextracted tobacco material or additional liquid having an aqueous character of both.

Humectants and/or binders can be optionally added such as described in U.S. Ser. No. 07/931,249, filed Aug. 17 1992. The mixture (slurry) can also be contacted with ammonia, or any other suitable reagent (e.g., potassium hydroxide, sodium hydroxide, etc.) capable of providing the mixture in the desired pH range of about 5 to about 9, and preferably about 6 to about 8. Preferably, the ammonia is essentially aqueous ammonium hydroxide. Although the manner of contact can vary, it generally is convenient to inject gaseous ammonia into the mixture. For example, gaseous anhydrous ammonia can be bubbled through the mixture. Alternatively, a concentrated ammonium hydroxide solution can be pumped into contact with the mixture. The amount of ammonia required to provide the mixture at the desired pH will be apparent to the skilled artisan. Normally, contact of the ammonia and mixture occurs at a temperature of about 35° C. to about 90° C., preferably about 40° C. to about 70° C., most preferably about 50° C. to about 60° C.

If desired, certain flavorful agents and tobacco flavor modifications can also be incorporated into the mixture (slurry). For example, menthol, vanillin, glycerine, potassium sorbate, licorice, cocoa, organic acids and the like, can be incorporated into the mixture. Tobacco flavor modifiers such as levulinic acid, metal salts (e.g., sodium, potassium, calcium and magnesium) of levulinic acid, and the like, may also be used. Other useful flavoring agents are set forth in Leffingwell et al., *Tobacco Flavoring For Smoking Products* (1972) and in European Patent Publication No. 407,792. Other additives such as urea, potassium sorbate, amino acids and organic acids (e.g. citric acid, malic acid and levulinic acid) can be incorporated in the tobacco material.

If desired, organic and inorganic materials can be incorporated as fillers in the tobacco material of the present invention. Such materials often have a fibrous, flake, crystalline, amorphous, hollow or particulate form. Examples of useful organic materials include wood pulp fibers, flax fibers and other cellulosic materials. Examples of useful inorganic materials include calcium carbonate, calcium sulfate particles, magnesium oxide, magnesium hydroxide, perlite, synthetic mica, vermiculite, clays, carbon such as in the form of thermally stable carbon fibers, zinc oxide, dowsonite, low density hollow spheres of calcium carbonate, glass spheres, glass bubbles, thermally stable carbon microspheres, alumina, calcium carbonate agglomerated using a carbonaceous component, calcium carbonate agglomerated using an organic material, low density processed calcium carbonate and the like.

The slurry is contacted with an agent capable of destroying the alkaline earth metal crosslinks of pectins present within the tobacco material such as described in commonly assigned U.S. Ser. No. 07/769,914 filed Sep. 30, 1991, the disclosure of which is incorporated herein by reference. Such an agent commonly is referred to as a "crosslink destruction agent" or a "pectin release agent." One preferred pectin release agent is a water soluble phosphate salt. Examples of such salts include diammonium hydrogen orthophosphate, ammonium dihydrogen orthophosphate, and potassium dihydrogen phosphate. Glyoxal and triethylene glycol can also be used as pectin release agents. See, also, those pectin release agents proposed in U.S. Pat. No. 3,435,829 to Hind, et al., and other methods of releasing pectins proposed in U.S. Pat. Nos. 4,674,519 to Keritsis et al., U.S. Pat. No. 4,972,854 to Kiernan et al. and U.S. Pat. No. 5,099,864 to Young et al., the disclosures of which are incorporated herein by reference. Normally, the pectin release agent is provided in solution form and then contacted with the tobacco material of the slurry to ensure destruction of the alkaline earth metal ion crosslinks of the pectins within such tobacco material. Typically this is done by mixing the pectin release agent with the tobacco slurry. The temperature of the mixture and pectin release agent during contact can vary, but usually ranges from about 20° C. to about 80° C., and is preferably about 25° C. to about 45° C. If desired, the pectin release agent can be formed in situ by contacting the tobacco material with separate components (e.g., an aqueous solution of ammonium hydroxide and an aqueous solution of phosphoric acid can be separately applied to the tobacco material).

The amount of pectin release agent which is contacted with the tobacco material of the slurry can vary, and can depend upon the particular pectin release agent. Typically, the amount of pectin release agent is sufficient to form precipitates with the alkaline earth metal ions which crosslink the tobacco pectins. However, the amount of pectin release agent should not be so high as to require the application of exceedingly high levels of alkaline earth metal ions (e.g., as tobacco extract and/or as water soluble alkaline earth salts) to the slurry of tobacco material in order to cause the re-crosslinking of the released tobacco pectins. That is, it is desirable to apply sufficient pectin release agent to the tobacco material to release the pectins therewithin; while it is desirable to avoid the application of a great excess pectin release agent so that the source of alkaline earth metal ions which is applied later in the process steps is employed to re-crosslink the released tobacco pectins rather than interact with pectin release agent. Typically, the amount of pectin release agent ranges from about 0.1 percent to about 10 percent, preferably about 2 percent to about 6 percent, based on dry weight of the tobacco material to which that agent is applied.

The slurry of tobacco material having released tobacco pectins is then formed into a sheet-like shape using a conventional forming machine or other means for forming known to those skilled in the art. For example, a forming machine comprising a headbox, a continuous belt preferably formed of a non-porous material such as stainless steel, and a series of dryers can be utilized. The slurry of tobacco material having released tobacco pectins is transferred to the headbox and is laid onto the belt as a sheet-like shape at a temperature of about 40° C. to a thickness of about 0.015 to about 0.030 inches, and preferably from about 0.020 inches to about 0.025 inches. If desired, prior to entering the headbox, the tobacco material having released tobacco pectins can be refined into particles having a uniform particle size such as utilizing a Fitz Mill Comminutor available from the Fitzpatrick Co., Elmhurst, Ill.

The formed tobacco material (cast slurry) is contacted with a crosslinking agent capable of crosslinking the released tobacco pectins and subjected to conditions sufficient to crosslink the released tobacco pectins. Such contact can occur as the cast slurry exits the headbox, as any drying occurs, or before the slurry is passed through the headbox prior to casting. Preferably, the crosslinking agent includes an agent capable of providing alkaline earth metal ions (e.g., calcium ions). It is understood that alkaline earth metal ions are naturally present in the slurry. Thus crosslinking can be commenced or initiated by heating and drying the slurry before, during or after casting. Drying causes the released tobacco pectins to have a propensity to crosslink due to a relative increase in concentration of the naturally present alkaline earth metal ions in the slurry as the moisture content thereof decreases.

It is desirable to provide sufficient alkaline earth metal ions to the cast slurry to provide a significant amount of crosslinking. Preferably, crosslinking is commenced by drying the cast slurry and additional alkaline earth metal ions are applied thereto. The alkaline earth metal ions are typically applied in a water soluble form. For example, the crosslinking agent can be a spray dried tobacco extract dissolved in water. The tobacco extract can be that extract previously separated from the tobacco material or can be a tobacco extract previously removed from a different tobacco material, (e.g., Oleoresin, an oriental tobacco extract available from Givaudan Corporation of East Hanover, N.J.). The source of alkaline earth metal ions can also be a water soluble alkaline earth metal salt (e.g., an aqueous solution of calcium chloride) occurring in the formed tobacco material (cast slurry).

Preferably, the crosslinking of the released tobacco pectins is controlled to either cause the released tobacco pectins to have the propensity to crosslink (i.e., the amount or rate of crosslinking is enhanced) or to not have the propensity to crosslink (i.e., the amount or rate of crosslinking is reduced or retarded) of the naturally present alkaline earth metal ions in the slurry as the moisture content of the cast slurry decreases. Different pH and temperature levels also can be utilized to control the crosslinking. Alternatively, the crosslinking agent can include a crosslinking control agent which controls the amount or rate of crosslinking, and can be applied to the cast slurry in combination with the alkaline earth metal ions. Exemplary crosslinking control agents include various organic acid flavor modifiers such as citric acid, malic acid, maleic acid, fumaric acid and levulinic acid; hydrogen chloride; ammonium chloride; and phosphate buffers. The use of different combinations and amounts of the various crosslinking control agents and crosslinking agents can be determined by routine experimentation depending on such factors as the composition of the tobacco material, treatment conditions of the cast slurry, treatment conditions of the tobacco material, amounts of pectin release agent employed and the like, and the determination thereof will be within the skill of one in the art.

The amount of crosslinking agent contacted with the formed tobacco material is at least sufficient to cause the released pectins to undergo alkaline earth metal crosslinking. For example, the crosslinking agent in the form of a spray dried tobacco extract dissolved in an aqueous liquid (water) can be uniformly applied to the tobacco material after or prior to being cast using a series of spray nozzles, roll presses, or other such means. However, the manner and number of times of applying the crosslinking agent to the tobacco material is not particularly critical. The amount of crosslinking agent applied to the tobacco material can vary and typically ranges from about 0.1 to about 0.5, and preferably about 0.2 to about 0.4 percent based on the dry weight of cast slurry prior to application of the crosslinking agent. Normally, the moisture content of the tobacco material just prior to the time that the further amount of crosslinking agent is applied thereto ranges from about 50 to 90 percent, and preferably from about 60 to 85 percent, based on the weight of the tobacco material and moisture. The resulting formed tobacco material is such that the weight thereof is greater than about 20 g/m$^2$, preferably about 25 g/m$^2$ to about 140 g/m$^2$, and more preferably about 80 g/m$^2$ to about 100 g/m$^2$, on a dry weight basis. The tobacco material having released tobacco pectins is heated and dried through the series of dryers to a moisture content of about 10 to about 20 weight percent, preferably to a moisture content of about 12 to about 14 weight percent. The dryer temperature and the adjustment thereof is within one skilled in the art. Drying of the formed slurry can be provided using a variety of techniques. For example, the formed slurry can be (i) air dried under ambient conditions, (ii) heated on a heated metal surface, (iii) subjected to contact with heated air, or (iv) heated on a heated metal surface and subjected to contact with heated air. The drying can occur simultaneous with the application of the crosslinking agent. The resulting reconstituted tobacco material is dried to a moisture content of about 10 to 20 weight percent, and preferably to a moisture content of about 12 to 14 percent. Typically the dryer is set such that the product dries at 100° C. or less for 1 to 4 minutes. In operation, the addition of the crosslinking agent causes the formed tobacco material to go from a shiny somewhat tacky material to a dull, flat non-tacky reconstituted tobacco material. The reconstituted tobacco material can be wound onto a bobbin and formed into smokable rods using techniques described in U.S. Pat. No. 4,807,809 to Pryor et al. and U.S. Pat. No. 5,074,320 to Jones, Jr. et al. and in U.S. patent application Ser. No. 585,444 filed Sep. 20, 1990. Reconstituted tobacco materials also can be formed into rods using a rod making unit available as CU-10 or CU-10S from Decoufle s.a.r.b., together with a KDF-2 rod making apparatus from Hauni-Werke Korber & Co., K.G.; or as set forth in U.S. Pat. No. 4,283,186 at col. 4, line 50 through col. 5, line 6, the disclosure of which is incorporated herein by reference. The reconstituted tobacco material can be slit, gathered and cut into strands, and formed into smokable rods such as described in U.S. Pat. No. 5,025,814 to Raker, the disclosure of which is incorporated herein by reference.

The following examples are provided in order to further illustrate various embodiments of the invention but should not be construed as limiting the scope thereof. Unless otherwise noted, all parts and percentages are by weight.

EXAMPLE 1

All tobacco material used in this example is ground to pass a 40 mesh (Tyler) screen. 35.92 g of tobacco material in the form of ground tobacco scrap is dispersed in 150 ml of tap water extraction solvent and extracted. About 125 ml of the extract and water is separated from the extracted tobacco scrap. The extracted tobacco scrap, 22.14 g of flue-cured tobacco stems, 19.11 g of Burley tobacco stems and 41.57 g of scrap tobacco are added to 700 ml of water heated to 95° C. 6.5 g of diammonium hydrogen orthophosphate is added to the stirred slurry and the pH is adjusted to 7.0 using a total of 12.3 ml of concentrated ammonium hydroxide solution and is heated to about 95° C. for an hour. The resulting slurry is subjected to high shear mixing using a Waring blender for about 3 minutes to provide a tobacco material having released tobacco pectins.

The slurry having released tobacco pectins is cast at a wet mass thickness of about 0.025 inches at a rate of about 2 gallons/min by extruding through the nip of a cast-sheet line head box. The cast mass is gradually dried at a temperature of about 100° C. to a moisture content of about 14 percent and has a weight of about 80 to about 140 g/m$^2$. 125 ml of extract recovered from the extraction is sprayed across the surface of the tobacco material as it is being dried. The reconstituted tobacco material has a low sheen, flat surface, and is non-tacky.

EXAMPLE 2

All tobacco material used in this example is ground to pass a 40 mesh (Tyler) screen. 19.11 g of tobacco material in the form of Burley stems is dispersed in 150 ml of tap water extraction solvent and extracted. A portion of the extract is separated from the extracted tobacco scrap. The extracted Burley stems, 22.14 g of flue-cured tobacco stems, and 78.49 g of scrap tobacco are added to 700 ml of water heated to 85° C. 6.5 g of diammonium hydrogen orthophosphate is added to the stirred slurry and the pH is adjusted to 7.0 using 12.3 ml of concentrated ammonium hydroxide solution and heating for while high shear mixing using a Waring blender for about 3 minutes to provide a tobacco material having released tobacco pectins.

The tobacco material having released tobacco pectins is cast at a wet mass thickness of about 0.025 inches at a rate of about 2 gallons/min by extruding through the nip of a cast-sheet line head box. The cast mass is gradually dried at a temperature of about 100° C. to a moisture content of about 14 percent. 125 ml of extract dissolved in water recovered from the extraction is sprayed across the surface of the tobacco material as it is being dried. The reconstituted tobacco material has a low sheen, flat surface, and is non-tacky.

EXAMPLE 3

All tobacco material used in this example is ground to pass a 40 mesh (Tyler) screen. 35.92 g of tobacco material in the form of tobacco scrap is dispersed in 150 ml of tap water extraction solvent and extracted. About 125 ml of the extract and water is separated from the extracted tobacco scrap. The extracted tobacco scrap, 22.14 g of flue-cured tobacco stems, 19.11 g of Burley tobacco stems and 42.57 g of scrap tobacco are added to 700 ml of water heated to 95° C. 6.5 g of diammonium hydrogen orthophosphate is added to the slurry and the pH is gradually adjusted to 7.5 over using a total of 26.2 ml of concentrated ammonium hydroxide solution about an hour at about 95° C. High shear mixing using a Waring blender is used for about 3 minutes to provide a tobacco material having released tobacco pectins. The tobacco material has a high sheen (i.e. shiny) surface and is tacky.

The tobacco material having released tobacco pectins is cast at a wet mass thickness of about 0.025 inches at a rate of about 2 gallons/min by extruding through the nip of a cast-sheet line head box. The cast mass is gradually dried at a temperature of about 100° C. to a moisture content of about 14 percent. 125 ml of extract recovered from the extraction is sprayed across the surface of the tobacco material as it is being dried. The reconstituted tobacco material has a low sheen, flat surface, and is non-tacky.

EXAMPLE 4

9.10 lbs of tobacco material in the form of stemmery dust is dispersed in 10 gal of tap water heated to 88° C. 0.78 lbs of cellulose pulp filler, 1.56 lbs of high fructose syrup (45% water) binding agent, 1.56 lbs of calcium sulfate filler and 0.12 lbs of 1:1 xantham gum and locust bean binding agent are added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.25 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mess screen and forming into a mass. The mass is cast at wet mass thickness of about 0.025 inches at a rate of about 2 gallons/min by extruding through the nip of a cast sheet line head box. The cast mass is saturated until visually moist with Oleoresin oriental tobacco extract available from Givaudin Corporatlon of East Hanover, N.J., and is gradually dried at a temperature of about 100° C. to a moisture content of about 14 percent.

EXAMPLE 5

11.4 lbs of tobacco material in the form of stemmery dust is dispersed in 9 gal of tap water heated to 88° C. 1.56 lbs of cellulose pulp filler and 0.12 lbs of 1:1 xantham gum and locust bean binding agent is added to the stemmery dust and mixed in a high shear Cowles mixer at 1160 rpm to provide a mixture while maintaining the 88° C. temperature. 0.73 lbs of diammonium hydrogen orthophosphate is added to the mixture and mixing is continued for 30 minutes. The pH is adjusted to 7.40 using 442.5 ml of ammonium hydroxide. The high shear mixing is continued for about 30 minutes to provide a tobacco material having released tobacco pectins.

The tobacco material having released tobacco pectins is sheared by passing through a Fitz Mill Comminutor having a 0.030 inch mesh screen and forming into a mass. The mass is cast at wet mass thickness of about 0.025 inches at a rate of about 2 gallons/min by extruding through the nip of a cast-sheet line head box. The cast mass is saturated until visually moist with Oleoresin oriental tobacco extract and is gradually dried at a temperature of about 100° C. to a moisture content of about 14 percent.

That which is claimed Is:

1. A method of providing a reconstituted tobacco material, the method comprising the steps of:

(a) contacting tobacco material with a liquid having an aqueous character to provide a slurry;

(b) subjecting the slurry to conditions sufficient to release tobacco pectins;

(c) forming the slurry having released tobacco pectins into a predetermined shape;

(d) contacting the formed slurry having released tobacco pectins with a crosslinking agent capable of crosslinking the released tobacco pectins and subjecting the formed slurry to conditions sufficient to crosslink the released tobacco pectins; and (e) drying the formed slurry having crosslinked tobacco pectins to provide a reconstituted tobacco material.

2. The method according to claim 1 whereby step (d) of contacting the formed slurry with a crosslinking agent and step (e) of drying the formed slurry are performed simultaneously.

3. The method according to claim 1 or 2 whereby the conditions sufficient to release tobacco pectins of step (b) includes contacting the slurry with a water soluble phosphate salt pectin release agent.

4. The method according to claim 1 or 2 whereby step (e) of drying the formed slurry having released tobacco pectins includes drying the slurry to a moisture content of about 10 to about 15 weight percent.

5. The method according to claim 1 or 2 whereby step (d) of contacting the formed slurry with a crosslinking agent and subjecting the formed slurry to crosslinking conditions is commenced before step (e) of drying the formed slurry.

6. The method according to claim 1 or 2 whereby the crosslinking agent of step (d) is an agent capable of providing alkaline earth metal ions.

7. The method according to claim 6 whereby the agent capable of providing alkaline earth metal ions is a water soluble salt alkaline earth metal calcium ions.

8. The method according to claim 1 or 2 whereby the crosslinking agent of step (d) is a water soluble tobacco extract.

9. A method of providing a reconstituted tobacco material, the method comprising the steps of:

(a) contacting tobacco material with an extraction solvent to provide a portion of tobacco extract separate from extracted tobacco material;

(b) dispersing the extracted tobacco material in a liquid having an aqueous character to provide a slurry;

(c) subjecting the slurry to conditions sufficient to release tobacco pectins;

(d) forming the slurry having released tobacco pectins into a predetermined shape;

(e) contacting the formed slurry having released tobacco pectins with a crosslinking agent capable of crosslinking the released tobacco pectins and subjecting the formed slurry to conditions sufficient to crosslink the release tobacco pectins; and (f) drying the formed slurry having crosslinked tobacco pectins to provide a reconstituted tobacco material.

10. The method according to claim 9 whereby step (e) of contacting the formed slurry with a crosslinking agent and step (f) of drying the formed slurry are performed simultaneously.

11. A method according to claim 9 or 10 whereby step (b) of dispersing the extracted tobacco material in a liquid having an aqueous character includes dispersing unextracted tobacco material in the liquid having an aqueous character.

12. A method according to claim 9 or 10 whereby the conditions sufficient to release tobacco pectins of step(c) includes contacting the slurry with a water soluble phosphate salt pectin release agent.

13. The method according to claim 9 or 10 whereby step (c) of drying the formed slurry having released tobacco pectins includes drying the slurry to a moisture content of about 10 to about 15 weight percent.

14. The method according to claim 9 or 10 whereby step (d) of contacting the formed slurry with a crosslinking agent and subjecting the formed slurry to crosslinking conditions is commenced before step (f) of drying the formed slurry.

15. The method according to claim 9 or 10 whereby the crosslinking agent of step (e) is an agent capable of providing alkaline earth metal ions.

16. The method according to claim 9 or 10 whereby the agent capable of providing alkaline earth metal ions is an agent capable of providing calcium ions in aqueous form.

17. The method according to claim 9 or 10 whereby the crosslinking agent of step (e) is a water soluble tobacco extract.

18. The method according to claim 9 or 10 whereby the crosslinking agent of step (e) is an aqueous solution of the tobacco extract separated from extracted tobacco material in step (a).

19. A method of providing a reconstituted tobacco material, the method comprising the steps of:

(a) contacting tobacco material with a liquid having an aqueous character to provide a slurry;

(b) subjecting the slurry to conditions sufficient to release tobacco pectins;

(c) contacting the formed slurry having released tobacco pectins with a crosslinking agent capable of crosslinking the released tobacco pectins and subjecting the formed slurry to conditions sufficient to crosslink the released tobacco pectins;

(d) forming the slurry having released tobacco pectins into a predetermined shape; and (e) drying the formed slurry having crosslinked tobacco pectins to provide a reconstituted tobacco material.

20. The method according to claim 19 whereby the conditions sufficient to release tobacco pectins of step (b) includes contacting the slurry with a water soluble phosphate salt pectin release agent.

21. The method according to claim 19 whereby step (e) of drying the formed slurry having released tobacco pectins includes drying the slurry to a moisture content of about 10 to about 15 weight percent.

22. The method according to claim 19 whereby the crosslinking agent of step (c) is an agent capable of providing alkaline earth metal ions.

23. The method according to claim 19 whereby the agent capable of providing alkaline earth metal ions is an agent capable of providing calcium ions in aqueous form.

24. The method according to claim 19 whereby the crosslinking agent of step (c) is a water soluble tobacco extract.

* * * * *